US005674668A

United States Patent [19]

Hagemann et al.

[11] Patent Number: 5,674,668

[45] Date of Patent: Oct. 7, 1997

[54] PHOTOGRAPHIC RECORDING MATERIAL

[75] Inventors: Jörg Hagemann, Köln; Günter Helling, Odenthal; Beate Weber, Leichlingen, all of Germany

[73] Assignee: Agfa-Gevaert, Germany

[21] Appl. No.: 704,461

[22] Filed: Aug. 26, 1996

[30] Foreign Application Priority Data

Sep. 6, 1995 [DE] Germany ..... 195 32 889.2

[51] Int. Cl.[6] ..... G03C 1/815

[52] U.S. Cl. ..... 430/507; 430/512; 430/931; 524/100; 544/216; 544/219

[58] Field of Search ..... 430/512, 931, 430/567; 524/100; 544/216, 219

[56] References Cited

U.S. PATENT DOCUMENTS

| | | | |
|---|---|---|---|
| 3,406,070 | 10/1968 | Oetiker et al. . | |
| 3,764,336 | 10/1973 | Nittel et al. | 430/546 |
| 3,765,897 | 10/1973 | Nittel | 430/512 |
| 3,843,371 | 10/1974 | Piller et al. | 430/512 |
| 4,203,716 | 5/1980 | Chen | 430/545 |
| 5,300,414 | 4/1994 | Leppard et al. | 430/512 |
| 5,364,749 | 11/1994 | Leppard et al. | 430/512 |
| 5,370,982 | 12/1994 | Tashiro et al. | 430/529 |
| 5,462,846 | 10/1995 | Yoneyama | 430/512 |
| 5,489,503 | 2/1996 | Toan | 430/512 |
| 5,538,840 | 7/1996 | Toan et al. | 430/512 |
| 5,541,045 | 7/1996 | Takahashi et al. | 430/512 |
| 5,597,854 | 1/1997 | Birbaum et al. | 430/512 |

FOREIGN PATENT DOCUMENTS

| | | |
|---|---|---|
| 0 099 861 | 2/1984 | European Pat. Off. . |
| 0 553 964 | 8/1993 | European Pat. Off. . |
| 0 571 935 | 12/1993 | European Pat. Off. . |
| 2107077 | 5/1972 | France . |
| 1472800 | 3/1969 | Germany . |
| 2113833 | 10/1971 | Germany . |

*Primary Examiner*—Richard L. Schilling
*Attorney, Agent, or Firm*—Connolly & Hutz

[57] ABSTRACT

A color photographic recording material having at least one silver halide emulsion layer, which material contains in at least one of its layers a combination of at least one UV absorber of the formula I and at least one low molecular weight or polymeric oil formula containing acid groups, for example of the formula $T—[R^{21}—(Q^1)_p]_q—X^{21}—OH$ (II), exhibits improved absorption for UV light.

(I)

In the formula I:

$R^1$ and $R^3$ mean H, halogen, hydroxy, mercapto, alkyl, aryl, alkoxy, aryloxy, acyloxy, alkylthio, arylthio, $—NR^5—R^6$, alkoxycarbonyl, carbamoyl or sulphamoyl;

$R^2$ means H, hydroxy, halogen or alkyl;

$R^4$ means alkyl, alkoxy, alkylthio, aryloxy, arylthio or a residue of the formula $R^5$ means H, alkyl or aryl;

$R^6$ means H, alkyl, aryl, acyl, alkoxycarbonyl, carbamoyl, sulphamoyl or sulphonyl;

m, n and o mean 1, 2, 3 or 4, wherein two or more residues $R^1$, $R^2$ and $R^3$ are identical or different;

in the formula II:

$X^{21}$ means $$—\overset{O}{\overset{\|}{C}}—,\ —\overset{O}{\overset{\|}{S}}—,\ —\underset{\underset{O}{\|}}{S}—\ \text{or}\ —\underset{\underset{(Q^2)_r—R^{22}}{|}}{\overset{O}{\overset{\|}{P}}}—$$

T means H or a segment of a polymer skeleton;

$Q^1$ and $Q^2$ mean —O— or $—NR^{22}—$;

$R^{21}$ means alkylene or arylene;

$R^{22}$ means H, alkyl or aryl;

p, q and r mean 0 or 1.

6 Claims, No Drawings

PHOTOGRAPHIC RECORDING MATERIAL

This invention relates to a photographic recording material which contains a UV absorber and an oil former in a photosensitive silver halide emulsion layer and/or in a non-photosensitive layer.

It is known to produce coloured photographic images by chromogenic development, i.e. by developing silver halide emulsion layers exposed with an image by means of suitable chromogenic developer substances, so-called colour developers, in the presence of suitable coupler, wherein the oxidation product of the developer substance, which oxidation product is produced congruently with the silver image, reacts with the colour coupler to form a dye image. Aromatic compounds containing primary amino groups, in particular those of p-phenylenediamine type, are normally used as colour developers.

It is also known that the image dyes produced by chromogenic development undergo certain changes to a varying extent under the action of environmental influences. This is particularly striking with regard to the action of light, in particular UV light.

It is known from EP-A 0 520 938, EP-A 0 530 135 and EP-A 0 531 258 to disperse hydroxyphenyltriazine UV absorbers in gelatine layers with the assistance of high-boiling solvents.

Hydroxyphenyltriazine UV absorbers are distinguished by elevated light stability and an elevated specific coefficient of absorbance in a dilute solution, which is distinctly higher that of the conventionally used hydroxyphenylbenzotriazole UV absorbers. However, dispersion in gelatine layers using conventional high-boiling solvents results in a distinct reduction in the specific coefficients of absorbance.

The object of the invention is to provide oil formers which improve the absorption characteristics of hydroxyphenyltriazine UV absorbers.

It has been found that the absorption characteristics of hydroxyphenyltriazine UV absorbers emulsified with high-boiling solvents may be improved if compounds having at least one acid group are used as the high-boiling solvent (oil former).

The present invention provides a colour photographic recording material having a layer support and, arranged thereon, at least one red-sensitive silver halide emulsion layer, at least one green-sensitive silver halide emulsion layer, at least one blue-sensitive silver halide emulsion layer and optionally further non-photosensitive layers, which material contains a UV absorber in at least one of its layers, characterised in that it contains in at least one of its photosensitive or non-photosensitive layers a combination of at least one UV absorber of the following general formula I and at least one low molecular weight or polymeric oil former containing acid groups:

(I)

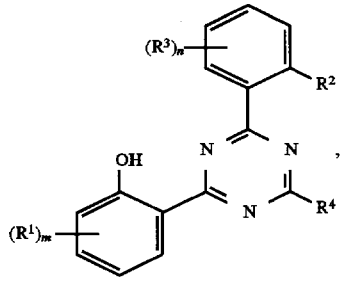

in which $R^1$ and $R^3$ mean H, halogen, hydroxy, mercapto, alkyl, aryl, alkoxy, aryloxy, acyloxy, alkylthio, arylthio, —$NR^5$—$R^6$, alkoxycarbonyl, carbamoyl or sulphamoyl;

$R^2$ means H, hydroxy, halogen or alkyl;

$R^4$ means alkyl, alkoxy, alkylthio, aryloxy, arylthio or a residue of the formula

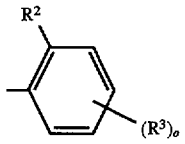

$R^5$ means H, alkyl or aryl;

$R^6$ means H, alkyl, aryl, acyl, alkoxycarbonyl, carbamoyl, sulphamoyl or sulphonyl;

m, n and o (identical or different) mean 1, 2, 3 or 4, and in which two or more residues $R^1$, $R^2$ and $R^3$ are identical or different.

The low molecular weight or polymeric oil formers containing acid groups are in particular compounds of the formula II $$T—[R^{21}—(Q^1)_p]_q—X^{21}—OH \qquad (II),$$

in which:

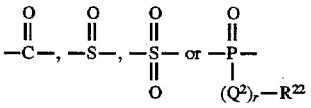

$X^{21}$ means

T means H or a segment of a polymer skeleton;

$Q^1$ and $Q^2$ mean —O— or —$NR^{22}$—;

$R^{21}$ means alkylene or arylene;

$R^{22}$ means H, alkyl or aryl;

p, q and r (identical or different) mean 0 or 1.

The alkylene and arylene residues denoted by $R^{21}$ and the alkyl and aryl residues denoted by $R^{22}$ contain up to 20 C atoms and may in turn bear further substituents. Examples of such substituents are halogen atoms, hydroxyl groups, alkoxy groups, acyloxy groups, alkoxycarbonyl groups, acylamino groups, carbamoyl groups, urea groups, further acid groups and alkyl side chains. In particular, alkyl and alkylene groups may be interrupted by oxygen atoms.

In a preferred embodiment of the invention, T (in formula II) denotes H and q denotes 1. In this case, the compounds are low molecular weight oil formers containing acid groups having at least 10 C atoms. Examples of such low molecular weight oil formers are stated below (compounds II-1 to II-19).

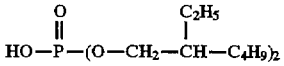
II-1
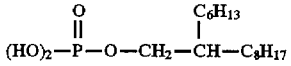
II-2
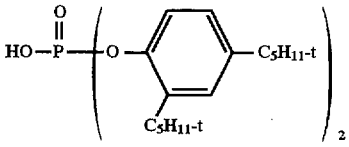
II-3
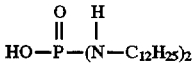
II-4
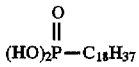
II-5
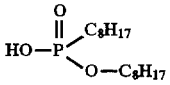
II-6
$HOSO_2-C_{16}H_{33}$
II-7
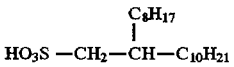
II-8
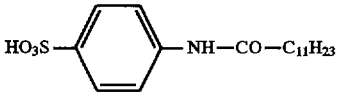
II-9
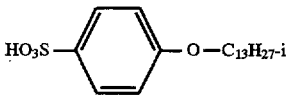
II-10
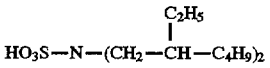
II-11
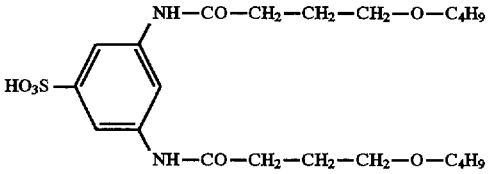
II-12
$HO_2S-C_{18}H_{37}$
II-13
$HO_2C-C_{17}H_{35}$
II-14
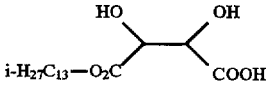
II-15
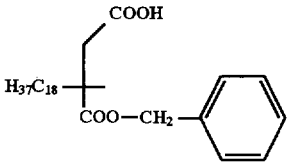
II-16
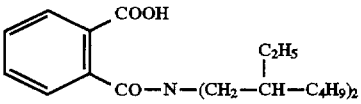
II-17

-continued

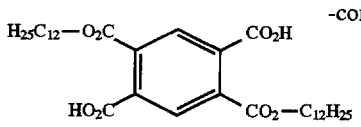

II-18

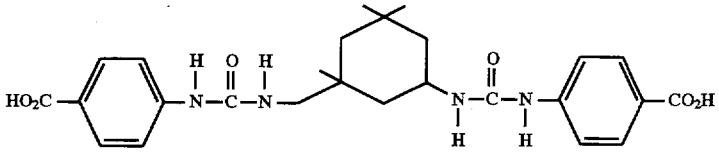

II-19

In another preferred embodiment of the invention, T (in formula II) denotes a segment of a polymer skeleton. In this case, the oil formers containing acid groups used according to the invention comprise a polymer with repeat units (segments), which contain at least one group of the formula $$-[R^{21}-(Q^1)_p]_q-X^{21}-OH,$$

wherein q preferably denotes 0. Suitable polymers are copolymers or poly-condensation or polyaddition products having an acid value of 10 to 200, preferably of 40 to 150. Examples of suitable monomers having acid groups for copolymers are: acrylic acid, methacrylic acid, itaconic acid, methacrylamideundecanoic acid, maleic acid, fumaric acid, vinylphosphonic acid, vinylsulphonic acid, 2-acrylamido-2-methylpropanesulphonic acid, sulphoethyl methacrylate, vinylbenzoic acid, methacrylamidopropyl phosphate, styrenesulphonic acid, acrylamidohexanecarboxylic acid, succinic acid semi-esters of hydroxyalkyl acrylates or methacrylates, phthalic acid semi-esters of hydroxylalkyl acrylates or methacrylates.

Examples of comonomers without acid groups are glycidyl methacrylate, N-(m-hydroxyphenyl)methacrylamide, 2-hydroxyethyl acrylate, 2-phenyl-1-vinylimidazole, 2-hydroxypropyl acrylate, N-isopropylacrylamide, N-(1,1-dimethyl-3-dimethyl-aminopropyl)acrylamide, 2-methyl-1 -vinylimidazole, 1 -vinylimidazole, N-vinyl-ε-caprolactam, p-methanesulphonamidostyrene, N-methylmethacrylamide, methacrylamide, N-(3-oxo-n-butyl)maleimide, maleimide, N-(2-aminoethyl)methacrylamide hydrochloride, 2-hydroxyethyl methacrylate, methacryloylurea, N-(3-aminopropyl)methacrylamide hydrochloride, N-(2-amino-2-methylpropyl)-methacrylamide, acrylonitrile, α-chloroacrylonitrile, methacrylonitrile, N-(2-hydroxypropyl) propyl)methacrylamide, N-acryloylpiperidine, N-vinylsuccinimide, N-vinylphthalimide, 2-hydroxypropyl methacrylate, 2-(5-ethyl-2-pyridyl)ethyl acrylate, N-(3-methacryloyloxypropyl)thiourea, N-vinyl-2-pyrrolidone, p-aminostyrene, 2-(N,N-dibutylamino)ethyl acrylate, N-(4-vinylphenyl)thiourea, 3-acrylamido-2-oxotetrahydrothiophene, N-(4-methacryloyloxyphenyl) methanesulphonamide, 1,1-dicyano-4-[N-(t-butyl)-N-(2-methacryloyloxyethylamino)-1,3-butadiene, N-(p-sulphamoylphenyl)maleimide, N-methacryloyl-p-toluenesulphonamide, N-(4-vinylphenyl)N'-methylthiourea, 2-acrylamido-2-hydroxymethyl-1,3-propanediol, N,N-dimethylmethacrylamide, N-methylacrylamide, 2-ureidoethyl vinyl ether, N-methacryloyl-N'-ureidoacetyl-hydrazine, N-vinyl-N'-(2-hydroxyethyl)succinamide, 2-methyl-5-vinylpyridine, N-vinyl-N'-(2-amino-2-methylpropyl)succinamide, N-vinylcarbazole, 2-vinylpyridine, 4-vinylpyridine, N-isopropylmethacrylamide, N,N-dimethylacrylamide, 2-(2-chloro-4,6-dimethylphenyl)-5-acrylamidopyrazolin-3-one, 2-(diethylamino)ethyl acrylate, 3,6-dimethyl-3,6-diazoheptyl acrylate, 2-(dimethylamino)ethyl acrylate, 2-(dimethyl-amino)ethyl methacrylate, 2-(diethylamino) ethyl methacrylate, 3-[3-(dimethylamino)-propyl] acrylamide, acrylamide, N-(3-methyl-5-oxo-3-heptyl) acrylamide, N-(2-methyl-4-oxo-2-pentyl)acrylamide, N-methyl-2-aminoethyl methacrylate hydrochloride, allyl alcohol, N-acryloylmethionine methyl ester, N-methylolacrylamide, N-(3- or 5-hydroxymethyl-2-methyl-4-oxo-2-pentyl)acrylamide, bis( 1 -dimethylaminoethyl)methyl methacrylate, N-(isobutoxymethyl)acrylamide, N-(isobutoxymethyl) methacrylamide, N-(m- and p-vinylbenzyl) -N,N-dimethylamine, m- and p-vinylbenzyl alcohol, 2-poly (ethyleneoxy)ethyl acrylate, ethylacrylamido acetate, methacryloyloxypolyglycerol, 2-(t-butylamino)ethyl methacrylate, 3-[2-dimethylamino)ethyl]acrylamide, 3-[2-(dimethylamino)ethyl]methacrylamide, 3-(diethylamino) propyl acrylate, 4-(diethylamino)-1 -methylbutyl acrylate, 4-[N-(2-acryloyloxyethyl)-N-ethylamino]-1,1 -dicyano-1,3-butadiene, 1,1 -dicyano-4-[N-( 1,1 -dimethylethyl)-N-(2-methacryloyloxyethyl)amino]-1,3 -butadiene, 1,1 -dicyano-4-([N-( 1 -dimethylethyl)-N-(2-methacryloyloxy-ethylcarbamoylethyl)amino]-1,3-butadiene, N,N-diethyl-5-(m- and p-10 vinylphenyl)-3-ketopentanoylamide, t-pentyl acrylate, n-pentyl acrylate, 3-pentyl acrylate, n-butyl acrylate, benzyl acrylate, t-butyl methacrylate, 5-methyl-1, 3,6-heptatriene, 1,1-dihydroperfluorobutyl acrylate, di-n-butyl-α-methylene glutarate, benzyl methacrylate, 3-oxo-n-butyl acrylate, t-butyl acrylate, cyclohexyl acrylate, cyclopentyl acrylate, cetyl acrylate, cyclohexyl methacrylate, cyclopentadiene, butadiene, 2-norbornylmethyl acrylate, 2-(p-toluene-sulphonyloxy) ethyl acrylate, trans-1,2-dichloroethylene, 2-norbornylmethyl methacrylate, diethylmethacryloyl malonate, dimethyl-α-methylene glutarate, ethyl methacrylate, ethylene, p-chlorostyrene, vinylthio (methylthio)methane, 1 -vinylthio-4-methylthiobutane, isobutyl acrylate, ethyl-N-acryloylglycine, ethyl-5-(m- and p-vinylphenyl)-3-ketopentanoate, methyl-5-(m- and p-vinylphenyl)-3-ketopentanoate, N-(3,6-dithiaheptyl) acrylamide, 2-ethylhexyl acrylate, bis(cyclohexylmethyl)-α-methylene glutarate, n-hexyl methacrylate, 3-ethyl-l-methylbutyl acrylate, N-(3,6-dithiaoctyl) acrylate, 2-ethylhexyl methacrylate, 2-isobornyl methacrylate, 6-(m- and p-vinylphenyl)-2,4-hexanedione, diisobutyl-α-methylene glutarate, chloroprene, bis(2-thiabutyl)methyl acrylate, n-butyl methacrylate, isobutyl methacrylate, 3-oxo-n-butyl methacrylate, isopropyl methacrylate, t-butyl-5-(m- and p-vinylphenyl)-3-ketopentanoate, lauryl acrylate, lauryl methacrylate, methyl acrylate, methyl α-chloroacrylate, methyl methacrylate, methyl vinyl ketone, 3-methyl-2-nitropropyl acrylate, 2-(3-nortricyclylmercapto) ethyl methacrylate, 1-vinylthio-3-methylthiopropane, 5-norbornen-2-yl-methyl methacrylate, N-(1,1-dimethyl-3-methylthiopropyl)acrylamide, 2-methyl-2-nitropropyl methacrylate, 5- (or 6-)methylmercapto2-norbornylmethyl methacrylate, 3,7-dithio-1-octene, 3-methyl-2-norbornylmethyl methacrylate, 4-methyl-2-propylpentyl acrylate, n-octyl acrylate, n-octadecyl acrylate, n-octadecyl methacrylate, 2-ethoxyethyl acrylate, 2-ethoxyethyl methacrylate, n-octyl methacrylate, 2-methoxyethyl methacrylate, 2-methoxyethyl acrylate, 2-methoxymethoxyethyl acrylate, 1,3,6-octanene, ethyl acrylate, propyl acrylate, 2-cyanoethyl acrylate, dicyclopentenyl acrylate, 2,2,2-trifluoroethyl acrylate, phenyl acrylate, isopropyl acrylate, n-propyl methacrylate, N-(1,1-dimethyl-3-ethylthiopropyl)acrylamide, N-(3-thiabutyl)acrylamide, N-(3-thiaheptyl)acrylamide, 2,5-dichlorostyrene, N-[2-(4-t-butylphenylthio)ethyl]-acryl-amide, N-(2-phenylthioethyl) acrylamide, N-[2-(p-tolylthio)ethyl]acrylamide, n-hexyl acrylate, N-(1, 1 -dimethyl-2-methylthioethyl)acrylamide, 2-methacryl-oyloxyethyl tosylate, N-(3-thiabutyl) methacrylamide, styrene, N-[2,2-bis(ethyl-thio)ethyl] acrylamide, sec.-butyl acrylate, p-bromostyrene, o-chlorostyrene, p-fluorostyrene, m-chlorostyrene, p-t-butylstyrene, m- and p-(2-thiapropyl)styrene, 2-(methylsulphinyl)ethyl acrylate, 2-(ethylsulphinyl)ethyl acrylate, trichloroethylene, 2,2-dimethylbutyl acrylate, neohexyl acrylate, 3-thiapentyl acrylate, N-(3-thiapentyl) methacrylamide, 3-thiapentyl methacrylate, N-(3-thiapentyl)acrylamide, N-t-butylacrylamide, vinyl acetate, vinyl bromide, butyl vinyl ether, vinylidene bromide, vinyl chloride, vinyl ethyl thioacetate, vinyl isobutyrate, vinyl chloroacetate, vinyl 2-ethylhexanoate, m- and p-vinyltoluene, 1-bromo-1-chloroethylene, vinyl neodecanoate, 3,4-dichlorostyrene, dimethyl-2-methyl-1,3-butadienyl phosphate, dimethyl-1-propen-2-yl phosphate, α-methylstyrene, methacryloyloxyethyl trifluoroacetate, N-phenylmaleimide, N-(p-chlorophenyl)maleimide, methyl vinyl ether, 2-(methoxymethhoxy)ethyl acrylate, vinylbenzyl acetate.

Examples of polymeric oil formers according to the invention containing acid groups are shown below (P-1 to P-10).

| | | Acid value |
|---|---|---|
| P-1 | $-[CH_2-CH(COOC_2H_5)]_{89}-[CH_2-CH(COOH)]_{11}-$ | 63 |
| P-2 | $-[CH_2-CH(COOC_2H_5)]_{60}-[CH_2-CH(COOC_4H_9)]_{32}-[CH_2-C(CH_3)(COOH)]_{8}-$ | 40 |
| P-3 | $-[CH_2-CH(COOC_3H_7i)]_{17}-[CH_2-CH(COOC_6H_{13})]_{78}-[CH_2-C(CH_2-COOH)(COOH)]_{5}-$ | 38 |
| P-4 | $-[CH_2-CH(CH_3)(COOC_4H_9)]_{35}-[CH_2-CH(COOC_4H_9)]_{58}-[CH_2-CH(COOH)]_{7}-$ | 30 |
| P-5 | $-[CH_2-CH(COOC_2H_5)]_{83}-[CH_2-C(CH_3)(COOH)]_{17}-$ | 97 |
| P-6 | $-[CH_2-CH(COOC_4H_9)]_{81}-[CH_2-CH(COO-CH_2-C_6H_5)]_{5}-[CH_2-C(CH_3)(COOH)]_{14}-$ | 64 |
| P-7 | $-[CH_2-CH(COOC_8H_{17}i)]_{78}-[CH_2-CH(COOCH_3)]_{3}-[CH_2-C(CH_3)(COOH)]_{19}-$ | 65 |

-continued

| | | Acid value |
|---|---|---|
| P-8 | 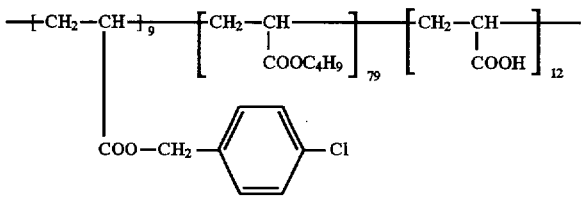 | 52 |
| P-9 | 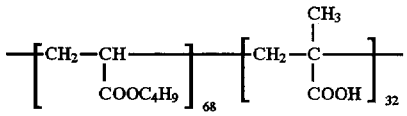 | 155 |

P-10: 2:1 reaction product prepared from pyromellitic acid and a polyester diol consisting of adipic acid, 1,3-butanediol and 1,4-butanediol ($n_D$(20° C.)=1.472,η(50° C.) =2000 to 3000 mPa –s, $d_{20}$=1.100 to 1.115 g/ml).

Further suitable polymeric compounds containing acid groups of the formula II are polyester carboxylic acids of a block-type structure, wherein each hydrophobic polyester block is followed by a hydrophilic block with two free carboxyl groups. Such polyester carboxylic acids are described, for example, in DE-A-38 30 522. The polyester carboxylic acids I-1 to I-13 described therein are also, for example, suitable.

In a preferred embodiment of the invention, the hydroxyphenyl UV absorbers are of the formula III

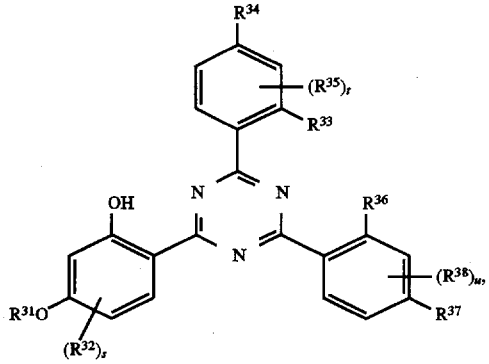

(III)

in which $R^{31}$ means H, alkyl, aryl or acyl;

$R^{32}$, $R^{35}$ and $R^{38}$ mean halogen, alkyl, aryl, alkoxy, aryloxy, acyloxy, alkylthio, arylthio or acylamino;

$R^{33}$, $R^{34}$, $R^{36}$ and $R^{37}$ (identical or different) mean H, -OH or a residue as $R^{32}$;

s, t and u mean 0, 1 or 2.

An alkyl residue denoted by $R^{31}$ to $R^{38}$ or contained therein may be linear, branched or cyclic and contain 1 to 36, preferably 1 to 20 C atoms. An alkyl or aryl residue denoted by $R^{31}$ to $R^{38}$ or contained therein may itself be substituted; possible substituents are the groups stated for $R^{32}$. An acyl residue denoted by $R^{31}$ to $R^{38}$ or contained therein may be derived from an aliphatic or aromatic carboxylic or sulphonic acid, a carbonic acid semi-ester, a carbamic acid or sulphonamide, a phosphoric or phosphonic acid. Two or more residues $R^{32}$, $R^{35}$and $R^{38}$ may be identical or different; these residues preferably denote alkyl, aryl, acylamino, acyloxy, halogen and/or alkoxy.

The following are examples of compounds of the formula I which are preferred according to the invention

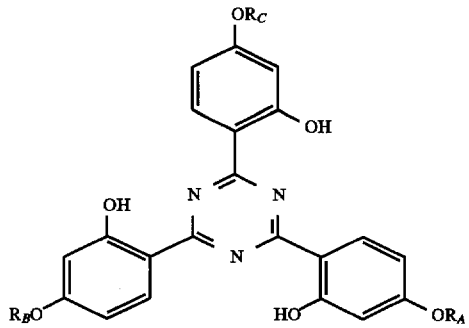

(IV)

$R_A = R_B = R_C =$  I-1

-continued $R_A = R_B = R_C = -CH_2-CH(OH)-C_6H_{13}$ I-2

$R_A = R_B = -C_4H_9\text{-s}$, $R_C = -C_{13}H_{23}\text{-i}$ I-3

$R_A = -CH_2-CH(OH)-CH_2-O-C_4H_9\text{-s}$, I-4

$R_B = -CH_2-CH(OH)-CH_2-O-CH(CH_3)-C_3H_7$ $R_C = R_A, R_B$ (1:1)

$R_A = -CH_2-CH_2-O-CH_2-CH_2-O-C_4H_9$, $R_B = R_C = -CH_2-CO_2-C_8H_{17}\text{-i}$, I-5

$R_A = R_B = R_C = -CH_2-CH(OH)-CH_2-O-CH_2-CH_2-O-CH(C_2H_5)-CH_3$ I-6

(V)

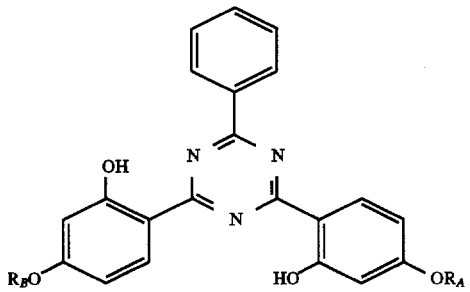

$R_A = R_B = -CH_2-CH(OH)-CH_2-O-C_9H_{19}\text{-i}$ I-7

$R_A = CH_2-CO-C_4H_9\text{-i}$, $R_B = -CH_2-CO_2-C_{13}H_{20}\text{-i}$, I-8

$R_A = R_B = -(CH_2-CH_2-O)_4-CH_3$, I-9

$R_A = R_B = -C_{10}H_{21}\text{-i}$ I-10

$R_A = -CH_2-CH(OH)-CH_2-O-C_4H_9\text{-s}$, I-11

$R_B = -CH_2-CH(OH)-CH_2-O-C(CH_3)-C_3H_7$

I-12

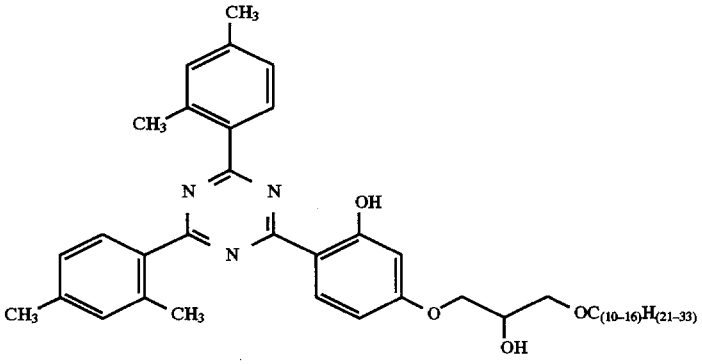

-continued
I-13
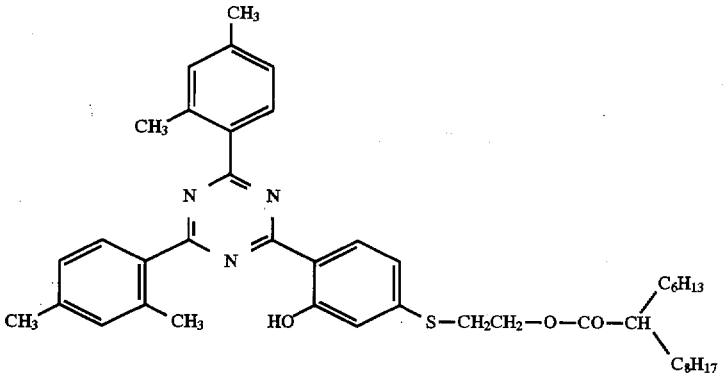
I-14
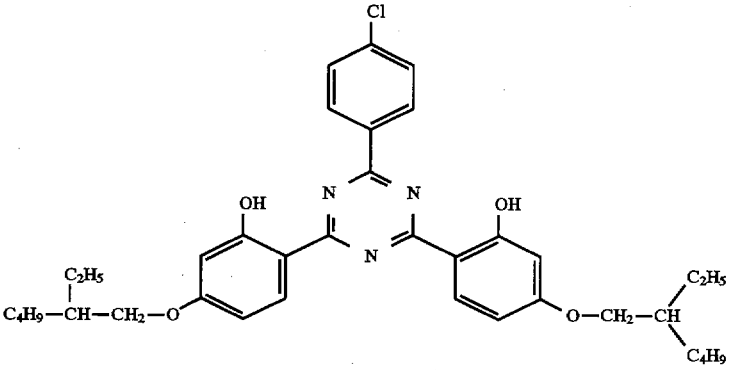
I-15
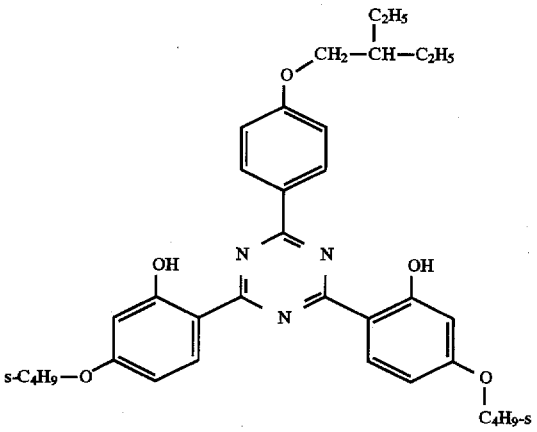
I-16
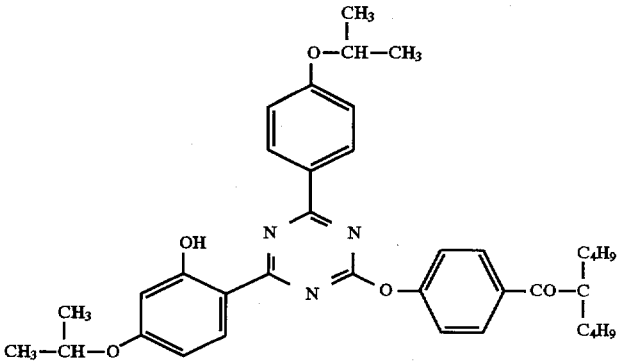

-continued

I-17

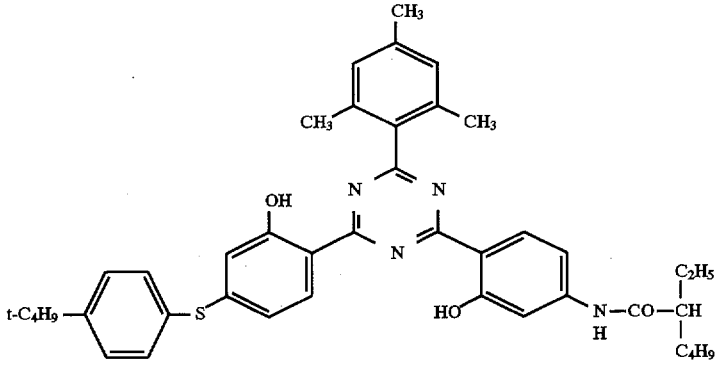

I-18

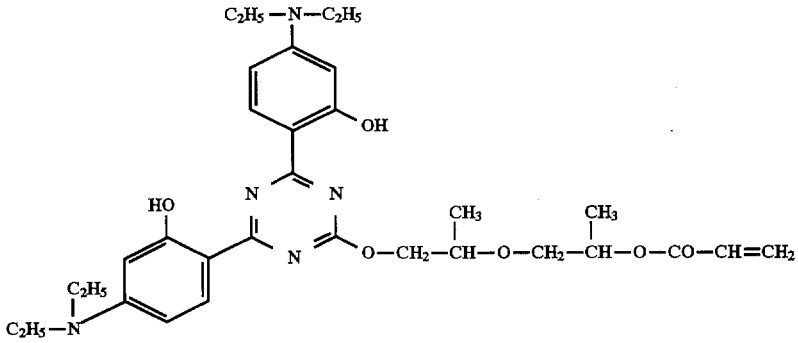

I-19

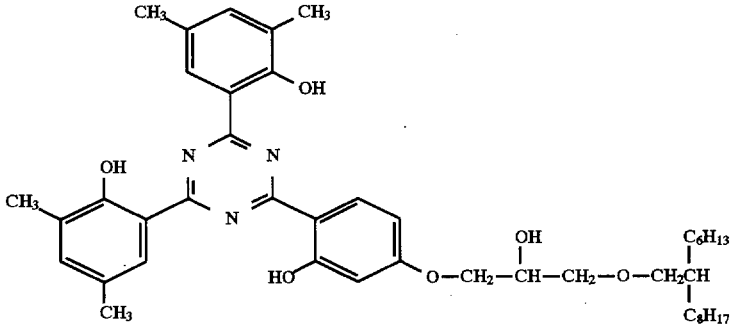

According to the invention, the low molecular weight or polymeric oil formers containing acid groups are used as oil formers for the hydroxyphenyltriazine UV absorbers of the formula I, i.e. oil formers containing acid groups and the UV absorber of the formula I are conveniently dispersed as a joint emulsion in the casting solution for the layer concerned. The quantities used for all layers together are 50 to 1500 mg/m$^2$, preferably 200 to 700 mg/m$^2$ for the UV absorber and 50 to 1500 mg/m$^2$, preferably 100 to 500 mg/m$^2$ for the oil former containing acid groups. The combination of hydroxyphenyltriazine UV absorber of the formula I and oil former containing acid groups is preferably used above or in the photosensitive silver halide emulsion layer furthest away from the layer support.

The recording material according to the invention exhibits distinctly improved absorption characteristics in the UV range. The hydroxyphenyltriazine UV absorbers dispersed using the oil formers according to the invention exhibit distinctly higher absorption in comparison with dispersion with conventional oil formers. This makes it possible to use smaller quantities while achieving the same action and so to reduce layer thickness.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 cyan-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally located between the green-sensitive and blue-sensitive layers to prevent blue light from reaching the underlying layers.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together another package of layers in order to increase sensitivity (DE 2 530 645).

Possible options for different layer arrangements and the effects thereof on photographic properties are described in *J. Int. Rec. Mats.*, 1994, volume 22, pages 183–193.

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride. Photographic print materials contain either silver chloride-bromide emulsions with up to 80 wt.% of AgBr or silver chloride-bromide emulsions with above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 μm in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, antioxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq..

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XXIII (1995), pages 95 et seq. together with example materials.

EXAMPLES

Example 1

Sample 1

The following layers are applied in the stated sequence onto a transparent polyester layer support. The stated quantifies are per 1 $m^2$.

1st layer (Substrate layer)

0.10 g of gelatine

2nd layer (UV layer)

1.00 g of gelatine 0.44 g of UV absorber I-1

0.44 g of dibutyl phthalate (DBP)

3rd layer (Protective layer)

0.50 g of gelatine 0.09 g of hardener XH-1

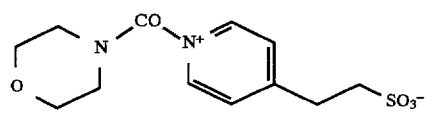

The longest wave absorption maximum ($\lambda_{max}$) and absorbance at $\lambda_{max}$ ($E(\lambda_{max})$) are then determined (table 1).

Samples 2 to 13

Samples 2 to 13 are produced in the same manner as sample 1, with the difference that the UV absorber and the oil former (DBP) in the third layer are replaced with the compounds stated in table 1.

TABLE 1

(C = comparison; I = according to the invention)

| Sample | UV absorber | Oil former | $\lambda_{max}$ [nm] | E ($\lambda_{max}$) |
|---|---|---|---|---|
| 1 (C) | I-1 | DBP | 355 | 1.96 |
| 2 (I) | I-1 | II-17 | 356 | 2.41 |
| 3 (C) | I-1 | COF-1 | 355 | 1.94 |
| 4 (I) | I-1 | P-6 | 355 | 2.39 |
| 5 (C) | I-4 | COF-2 | 356 | 2.03 |
| 6 (I) | I-4 | COF-3/II-1 (1:1) | 356 | 2.61 |
| 7 (C) | I-4 | COF-1 | 356 | 1.98 |
| 8 (I) | I-4 | P-10 | 357 | 2.47 |
| 9 (C) | I-7 | COF-3 | 352 | 1.72 |
| 10 (I) | I-7 | COF-3/II-2 (3:2) | 352 | 2.14 |
| 11 (I) | I-7 | COF-3/II-8 (1:1) | 353 | 2.20 |
| 12 (C) | I-8 | COF-4 | 353 | 1.69 |
| 13 (I) | I-8 | P-5 | 353 | 2.07 |

COF-1 Polyester prepared from adipic acid, 1,3-butanediol and 1,4-butanediol

COF-2

COF-2 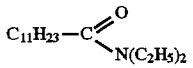

COF-3

COF-3 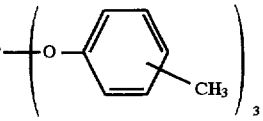

COF-4 Poly-tert.-butylacrylamide

As is shown by table 1, the oil formers according to the invention improve the absorption of the UV absorbers according to the invention by more than 20% in comparison with the conventional oil formers COF-1 to COF-4.

Example 2

Samples 1 to 13 are exposed to $40\times10^6$ lux-h of light from a daylight- standardised xenon lamp. The decrease in $E(\lambda_{max})$ is between 2 and 4% in all samples, i.e. the oil formers according to the invention do not degrade light stability.

Example 3

A multilayer colour photographic recording material was produced (layer structure A) by applying the following layers in the stated sequence onto a layer support of paper coated on both sides with polyethylene. All stated quantities are per 1 $m^2$, the quantity of silver is stated as $AgNO_3$:

Layer 1 (Substrate layer)

0.10 g of gelatine

Layer 2 (Blue-sensitive layer)

Blue-sensitive silver halide emulsion (99.5 mol. % chloride, 0.5 mol. % bromide, average grain diameter 0.9 μm) prepared from 0.50 g of $AgNO_3$ with 1.25 g of gelatine 0.42 g of yellow coupler XY-1

0.18 g of yellow coupler XY-2

0.50 g of tricresyl phosphate (TCP)

0.10 g of stabiliser XST-1

0.70 mg of blue sensitiser XBS-1

0.30 mg of stabiliser XST-2

Layer 3 (Interlayer)

1.10 g of gelatine 0.06 g of oxform scavenger XSC-1

0.06 g of oxform scavenger XSC-2

0.12 g of TCP

Layer 4 (Green-sensitive layer)

Green-sensitive silver halide emulsion (99.5 mol. % chloride, 0.5 mol. % bromide, average grain diameter 0.47 μm) prepared from 0.40 g of $AgNO_3$ with 0.77 g of gelatine 0.41 g of magenta coupler XM-1

0.06 g of stabiliser XST-3

0.12 g of oxform scavenger XSC-2

0.34 g of dibutyl phthalate (DBP)

0.70 mg of green sensitiser XGS-1

0.50 mg of stabiliser XST-4

Layer 5 (UV protective layer)

0.95 g of gelatine 0.30 g of UV absorber I-11

0.03 g of oxform scavenger XSC-1

0.03 g of oxform scavenger XSC-2

0.30 g of TCP

Layer 6 (Red-sensitive layer) Red-sensitive silver halide emulsion (99.5 mol. % chloride, 0.5 mol. % bromide, average grain diameter 0.5 μm) prepared from 0.30 g of $AgNO_3$ with 1.0 g of gelatine 0.46 g of cyan coupler XC-1

0.46 g of TCP 0.03 mg of red sensitiser XRS-3

0.60 mg of stabiliser XST-5

Layer 7 (UV protective layer)

0.30 g of gelatine 0.10 g of UV absorber I-11

0.10 g of TCP

Layer 8 (Protective layer)

0.90 g of gelatine 0.05 g of optical brightener XWT-1

0.07 g of mordant (PVP)

1.20 mg of silicone oil 2.50 mg of spacer (polymethylmethacrylate, average grain diameter 0.8 μm)

0.30 g of hardener XH-1

Layer structures B to J

Layer structures B to J are produced in the same manner as layer structure A with the difference that the UV absorber and the oil former (TCP) in layers 5 and 7 were replaced by those stated in table 2. Furthermore, in layer structures E to J in layer 2 yellow couplers XY-1 and XY-2 and stabiliser XST-1 were replaced by identical quantifies of XY-3 and XST-6 respectively, and in layer 4 magenta coupler XM-1 was replaced by 0.20 g of XM-2, oxform scavenger XSC-2 by 0.20 g of stabiliser XST-7 and stabiliser XST-3 by 0.10 g of XST-8, as may be seen from table 2.

Compounds used in example 3:

XY-1
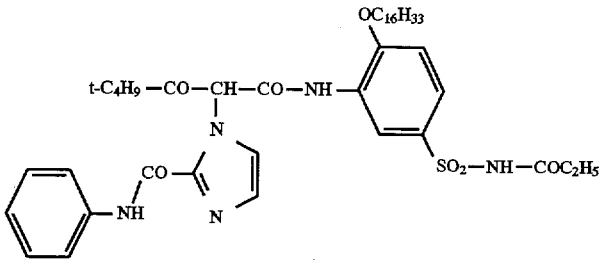
XY-2
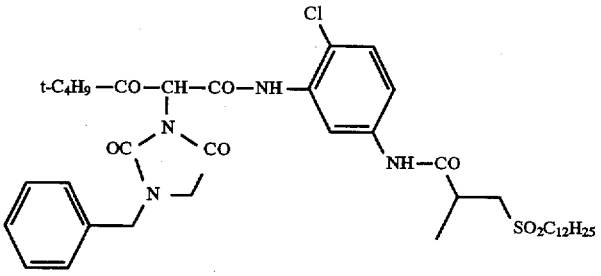
XY-3
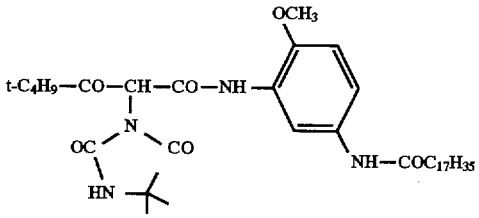
XM-1
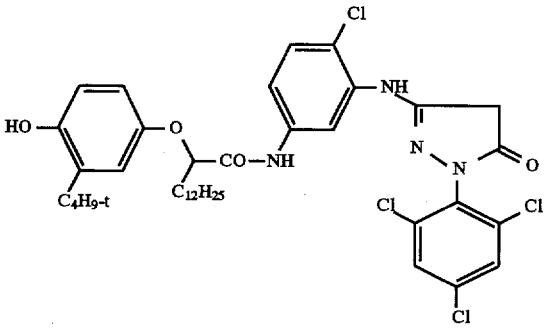
XM-2
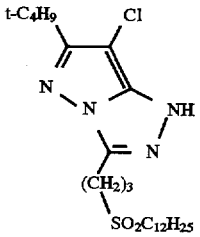
XC-1
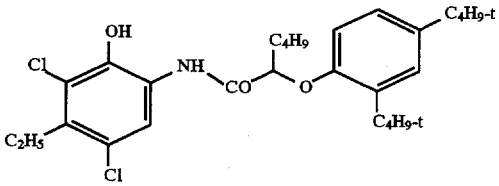

-continued
XBS-1
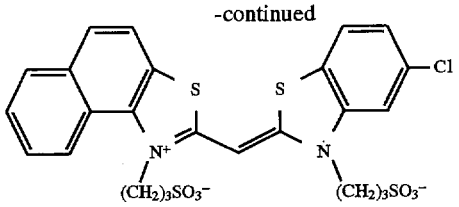
$Et_3N^+H$
XGS-1
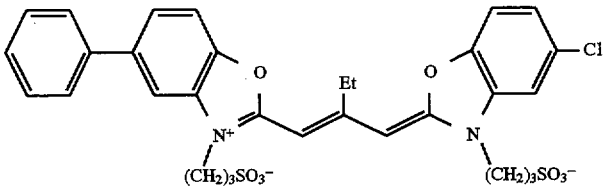
$K^+$
XRS-1
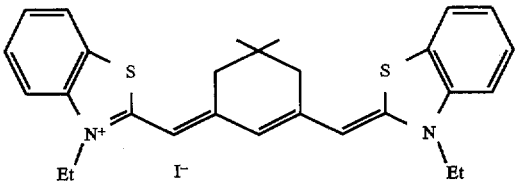
XST-1
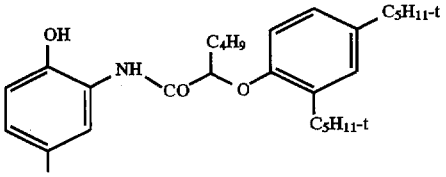
XST-2
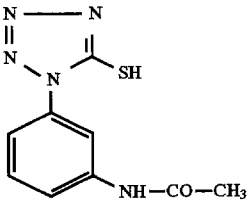
XST-3
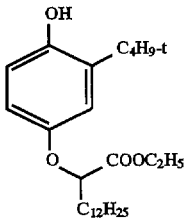
XST-4
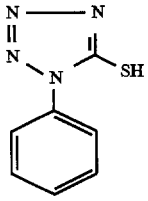
XST-5
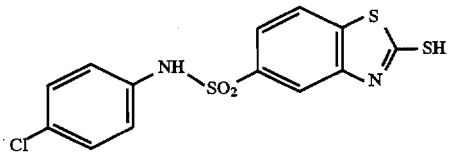

-continued

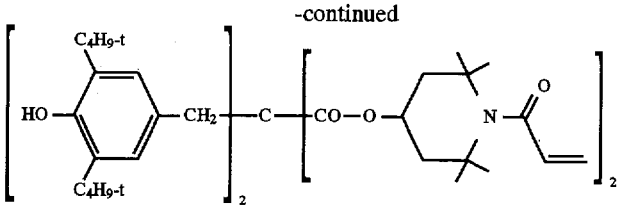

XST-6

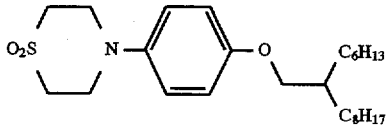

XST-7

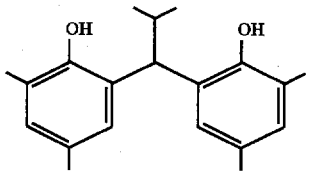

XST-8

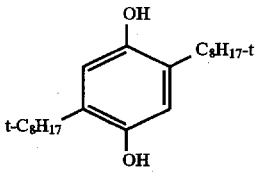

XSC-1

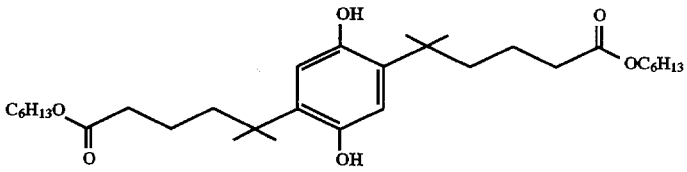

XSC-2

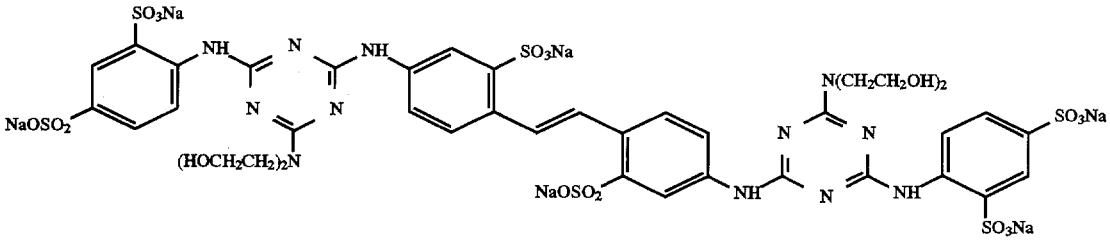

XWT-1

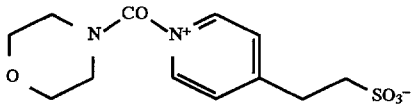

XH-1

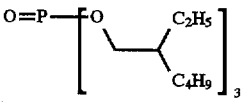

COF-5

The colour photographic recording material was exposed through a step wedge. On exposure, additional filters are placed in the beam path of the exposure unit such that the wedge appears neutral at an optical density of D=0.6. The exposed material is processed using the following method:

| Stage | Time | Temperature |
|---|---|---|
| Development | 45 s | 35° C. |
| Bleach/fixing | 45 s | 35° C. |
| Rinsing | 90 s | 33° C. |

-continued

| Colour developer solution (CD) | |
|---|---|
| Tetraethylene glycol | 20.0 g |
| N,N-diethylhydroxylamine | 4.0 g |
| (N-ethyl-N-(2-methanesulphonamido)ethyl)-4-amino-3-methylbenzene sulphate | 5.0 g |
| Potassium sulphite | 0.2 g |
| Potassium carbonate | 30.0 g |
| Polymaleic anhydride | 2.5 g |
| Hydroxyethanediphosphonic acid | 0.2 g |
| Optical brightener (4,4'-diaminostilbene type) | 2.0 g |
| Potassium bromide | 0.02 g |

-continued

| | |
|---|---|
| make up to 1000 ml with water, adjust pH to 10.2 with KOH or $H_2SO_4$. | |
| Bleach/fixing solution (BX) | |
| Ammonium thiosulphate | 75.0 g |
| Sodium hydrogen sulphite | 13.5 g |
| Ethylenediaminetetraacetic acid (iron/ammonium salt) | 45.0 g |
| make up to 1000 ml with water, adjust pH to 6.0 with ammonia (25%) or acetic acid. | |

The samples are then exposed to 20×106 lux-h of light from a daylight-standardised xenon lamp and the percentage decrease determined (table 2).

TABLE 2

(C = comparison, I = according to the invention)

| Layer structure | UV absorber | Oil former | % decrease in density at initial density D = 1.0 yellow | magenta | cyan |
|---|---|---|---|---|---|
| A (C) | I-11 | TCP | 43 | 54 | 46 |
| B (C) | I-16 | COF-4 | 44 | 53 | 46 |
| C (I) | I-11 | TCP/II-10 (1:1) | 39 | 47 | 41 |
| D (I) | I-16 | P-9 | 39 | 46 | 42 |
| E (C) | I-3 | DBP | 35 | 53 | 43 |
| F (C) | I-4 | COF-1 | 34 | 53 | 42 |
| G (I) | I-3 | II-16 | 30 | 43 | 36 |
| H (I) | I-3 | P-10 | 32 | 44 | 38 |
| I (I) | I-4 | COF-5/II-1 (1:1) | 31 | 45 | 38 |
| J (I) | I-4 | P-1 | 32 | 45 | 39 |

As may be seen from table 2, the decrease in density of the image dyes on irradiation is appreciably reduced by using the oil formers according to the invention.

We claim:

1. A color photographic recording material comprising a layer support and, arranged thereon, at least one red-sensitive silver halide emulsion layer, at least one green-sensitive silver halide emulsion layer, at least one blue-sensitive silver halide emulsion layer and optionally further non-photosensitive layers, which material contains a UV absorber in at least one of its layers, wherein the recording material contains in at least one of its photosensitive or non-photosensitive layers a combination of at least one UV absorber of the formula I and at least one low molecular weight or polymeric oil former containing acid groups:

(I)

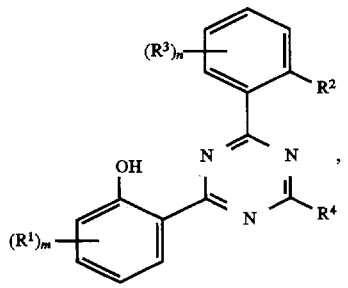

in which $R^1$ and $R^3$ are identical or different and mean H, halogen, hydroxy, mercapto, alkyl, aryl, alkoxy, aryloxy, acyloxy, alkylthio, arylthio, $—NR^5—R^6$, alkoxycarbonyl, carbamoyl or sulphamoyl;

$R^2$ means H, hydroxy, halogen or alkyl;

$R^4$ means alkyl, alkoxy, alkylthio, aryloxy, arylthio or a residue of the formula

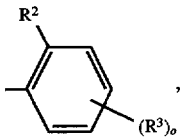

$R^2$ and $R^3$ are defined above $R^5$ means H, alkyl or aryl;

$R^6$ means H, alkyl, aryl, acyl, alkoxycarbonyl, carbamoyl, sulphamoyl or sulphonyl;

m, n and o, are identical or different and mean 1, 2, 3 or 4, and in which two or more residues $R^1$, $R^2$ and $R^3$ are identical or different.

2. Recording material according to claim 1, wherein the low molecular weight or polymeric oil former is of the formula II $$T—[R^{21}—(Q^1)_p]_q—X^{21}—OH \quad (II),$$

in which $X^{21}$ means

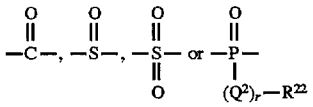

T means H or a segment of a polymer skeleton;

$Q^1$ and $Q^2$ are identical or different and mean —O— or $—NR^{22}$;

$R^{21}$ means alkylene or arylene;

$R^{22}$ means H, alkyl or aryl;

r, q and r, are identical or different and mean 0 or 1.

3. Recording material according to claim 1, wherein the UV absorber is of the formula III:

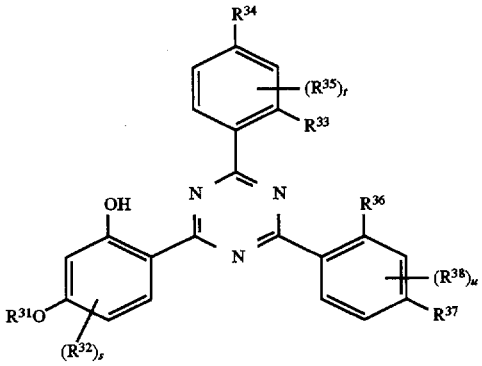

in which $R^{31}$ means H, alkyl, aryl or acyl;

$R^{32}$, $R^{35}$ and $R^{38}$ are identical or different and mean halogen, alkyl, aryl, alkoxy, aryloxy, acyloxy, alkylthio, arylthio or acylamino;

$R^{33}$, $R^{34}$, $R^{36}$ and $R^{37}$ are identical or different and mean H, —OH or a residue as $R^{32}$;

s, t and u are identical or different and mean 0, 1 or 2.

4. Recording material according to claim 2, wherein the UV absorber of the formula I and the oil former containing acid groups of the formula II are each contained in the recording material in a total quantity of 50 to 1500 mg/m$^2$.

5. Recording material according to claim 2, wherein the combination of UV absorber of the formula I and the oil formula containing acid groups of the formula II is contained at least in the photosensitive silver halide emulsion layer furthest from the layer support or in a non-photosensitive layer still further from the layer support.

6. The recording material according to claim 2, wherein q is 0.

* * * * *